US011512616B2

(12) United States Patent
Asami

(10) Patent No.: US 11,512,616 B2
(45) Date of Patent: Nov. 29, 2022

(54) OIL PAN STRUCTURE FOR INTERNAL COMBUSTION ENGINE

(71) Applicant: HONDA MOTOR CO., LTD., Tokyo (JP)

(72) Inventor: Takashi Asami, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/195,946

(22) Filed: Mar. 9, 2021

(65) Prior Publication Data

US 2021/0285347 A1 Sep. 16, 2021

(30) Foreign Application Priority Data

Mar. 12, 2020 (JP) ..... JP2020-042845

(51) Int. Cl.
*F01M 11/00* (2006.01)

(52) U.S. Cl.
CPC ... *F01M 11/0004* (2013.01); *F01M 2011/002* (2013.01); *F01M 2011/0037* (2013.01); *F01M 2011/0054* (2013.01); *F01M 2011/0058* (2013.01)

(58) Field of Classification Search
CPC ..... F01M 11/0004; F01M 2011/002; F01M 2011/0037; F01M 2011/0054; F01M 2011/0058
USPC ..... 184/106
See application file for complete search history.

(56) References Cited

FOREIGN PATENT DOCUMENTS

| | | | | |
|---|---|---|---|---|
| CN | 201671679 U | | 12/2010 | |
| DE | 102006025745 A1 | * | 12/2007 | ..... F01M 11/0004 |
| JP | S55-132345 U | | 9/1980 | |
| JP | S57-49044 A | | 3/1982 | |
| JP | H01-61443 U | | 4/1989 | |
| JP | 5-033721 Y2 | | 8/1993 | |
| JP | 8-144848 A | | 6/1996 | |
| KR | 10-2013-0001616 A | | 1/2013 | |

OTHER PUBLICATIONS

Office Action dated Oct. 26, 2021, issued in counterpart JP Application No. 2020-042845, with English Translation. (10 pages).

* cited by examiner

*Primary Examiner* — Lindsay M Low
*Assistant Examiner* — Omar Morales
(74) *Attorney, Agent, or Firm* — WHDA, LLP

(57) ABSTRACT

The present disclosure describes an oil pan structure including a storing portion that stores oil for an internal combustion engine. The storing portion includes a shallow bottom portion, a deep bottom portion deeper than the shallow bottom portion, and a connection surface that connects the shallow bottom portion and the deep bottom portion between the shallow bottom portion and the deep bottom portion. A side wall is formed at a position facing the connection surface with the shallow bottom portion interposed between the side wall and the connection surface. A rib is formed on a back surface of the shallow bottom portion so as to extend from one side or another side of the side wall in a width direction of the shallow bottom portion toward an end portion of the connection surface on an opposite side in the width direction.

10 Claims, 4 Drawing Sheets

OIL PAN STRUCTURE FOR INTERNAL COMBUSTION ENGINE

CROSS REFERENCES TO RELATED APPLICATIONS

The present application claims priority under 35 U.S.C. § 119 to Japanese Patent Application No. 2020-042845, filed Mar. 12, 2020, entitled "Oil Pan Structure for Internal Combustion Engine." The contents of this application are incorporated herein by reference in their entirety.

TECHNICAL FIELD

The present disclosure relates to an oil pan structure used for an internal combustion engine.

BACKGROUND

Internal combustion engines include, in addition to a cylinder and a cylinder block, an oil pan that is disposed below the cylinder block and that stores oil. The oil pan is in contact with the cylinder block, and vibration of the cylinder block is thus transmitted to the oil pan. In this case, vibration of the oil pan may cause noise of the engine.

Examples of an existing oil pan structure for eliminating such a malfunction include a structure that includes a rib disposed in the longitudinal direction in an outer portion of an oil pan and a rib disposed orthogonally to the rib disposed in the longitudinal direction to increase the rigidity of the oil pan (for example, see Japanese Unexamined Patent Application Publication No. 8-144848). In addition, another example of such an existing oil pan structure is a structure that includes a plurality of ribs disposed in an oil pan including a shallow bottom portion, a deep bottom portion, and a boundary wall between the shallow bottom portion and the deep bottom portion. The plurality of ribs extend in the longitudinal direction between a center portion of the back surface of the shallow bottom portion and the back surface of the boundary wall (for example, see ribs 33 in Japanese Examined Utility Model Registration Application Publication No. 5-033721).

SUMMARY

The existing oil pan structures including a rib can increase the rigidity of an oil pan more than an oil pan structure not including a rib. However, transmissions or drive mechanisms have become larger in recent years, and the existing oil pan structures are thus insufficient to reduce the vibration of an oil pan caused by stronger vibration. In particular, in an oil pan including a shallow bottom portion and a deep bottom portion, it is likely that the rigidity of a connection surface that connects the shallow bottom portion and the deep bottom portion is lower than that of a surrounding portion of the connection surface. When the connection surface is thickened to increase the rigidity of the oil pan, the weight of the oil pan increases, thus causing an increase in the weight of an internal combustion engine.

The present application describes, for example, an oil pan structure for an internal combustion engine capable of increasing the rigidity of a connection surface between a shallow bottom portion and a deep bottom portion with an oil pan reduced in weight.

In a first aspect of the present disclosure, an oil pan structure includes a storing portion that stores oil for an internal combustion engine. The storing portion includes a shallow bottom portion, a deep bottom portion deeper than the shallow bottom portion, and a connection surface that connects the shallow bottom portion and the deep bottom portion between the shallow bottom portion and the deep bottom portion. A side wall is formed at a position facing the connection surface with the shallow bottom portion interposed between the side wall and the connection surface. A rib is formed on a back surface of the shallow bottom portion so as to extend from one side or another side of the side wall in a width direction of the shallow bottom portion toward an end portion of the connection surface on an opposite side in the width direction.

When a rib having such a configuration is formed on the back surface of the shallow bottom portion, the back surface of the shallow bottom portion is reinforced in the diagonal directions. As a result, the rigidity of the oil pan can be efficiently increased by ribs whose number is less than, for example, that of ribs formed into a grid-like pattern in the width direction and a direction orthogonal to the width direction of the shallow bottom portion or that of ribs formed in the direction orthogonal to the width direction of the shallow bottom portion. Accordingly, it is possible to increase the rigidity of the connection surface between the shallow bottom portion and the deep bottom portion with the oil pan reduced in weight.

In a second aspect of the present disclosure, in the oil pan structure according to the first aspect, preferably, the internal combustion engine includes a cylinder block, a block flange configured to be in contact with the cylinder block is formed on a front surface of the storing portion, and a second rib is formed so as to be along an end portion of a back surface of the connection surface and to reach a back surface of the block flange.

As described above, the second rib formed so as to be along the end portion of the back surface of the connection surface increases the rigidity of the end portion of the connection surface and is connected to the block flange having a high rigidity. Accordingly, this configuration can increase the rigidity of the connection surface more than the case in which only the rib is formed.

In a third aspect of the present disclosure, in the oil pan structure according to the second aspect, preferably, the rib is formed such that a portion closer to the connection surface of the rib is smaller in thickness than a portion farther from the connection surface of the rib.

Sufficient rigidity of the connection surface is maintained by forming the second rib in the second aspect on the connection surface. Thus, as described above, the rib can be formed such that a portion closer to the connection surface of the rib is smaller in thickness than a portion farther from the connection surface of the rib. In addition, a portion closer to the connection surface of the rib is smaller in thickness, and the oil pan can thus be reduced in weight.

In a fourth aspect of the present disclosure, in the oil pan structure according to any one of the first to third aspects, preferably, at least two ribs, each of which is the rib, are disposed, and the two ribs are formed so as to intersect each other.

As described above, the configuration in which the two ribs formed in the corresponding diagonal directions intersect each other reinforces the whole back surface of the shallow bottom portion and thus enables the rigidity of the oil pan to be effectively increased.

In a fifth aspect of the present disclosure, in the oil pan structure according to any one of the first to fourth aspects, preferably, the rib is formed so as to range from the side wall to the end portion of the connection surface.

As described above, the configuration in which the rib is formed so as to range from the side wall to the end portion of the connection surface enables the end portion having relatively high rigidity of the connection surface and the side wall having a high rigidity to be connected and the rigidity of the oil pan to thus be effectively increased.

In a sixth aspect of the present disclosure, in the oil pan structure according to any one of the first to fifth aspects, preferably, the internal combustion engine is disposed adjacent to a transmission or a drive mechanism, and the side wall is a flange that forms a part of the transmission or the drive mechanism.

As described above, the configuration in which the side wall is a flange having a high rigidity and the rib is formed so as to be connected to the flange enables the rigidity of the oil pan to be effectively increased.

In a seventh aspect of the present disclosure, in the oil pan structure according to any one of the first to sixth aspects, preferably, a third rib ranging from the side wall to the connection surface is formed on one side and another side with respect to the rib in the width direction of the back surface of the shallow bottom portion.

As described above, the configuration in which the third rib is formed outside the rib in the width direction of the shallow bottom portion further increases the rigidity of the oil pan. In addition, the configuration in which the third rib is formed so as to range from the side wall to the connection surface enables the rigidity of the oil pan to be increased.

BRIEF DESCRIPTION OF THE DRAWINGS

The advantages of the disclosure will become apparent in the following description taken in conjunction with the following drawings.

DESCRIPTION OF THE PREFERRED EMBODIMENTS

An oil pan structure for an internal combustion engine according to a preferred embodiment of the present disclosure will be described in detail below with reference to the drawings. In the following descriptions, a longitudinal direction is the direction in which a shallow bottom portion 11 and a deep bottom portion 12 are adjacent to each other, and a width direction is a direction orthogonal to the longitudinal direction.

Figure 1:
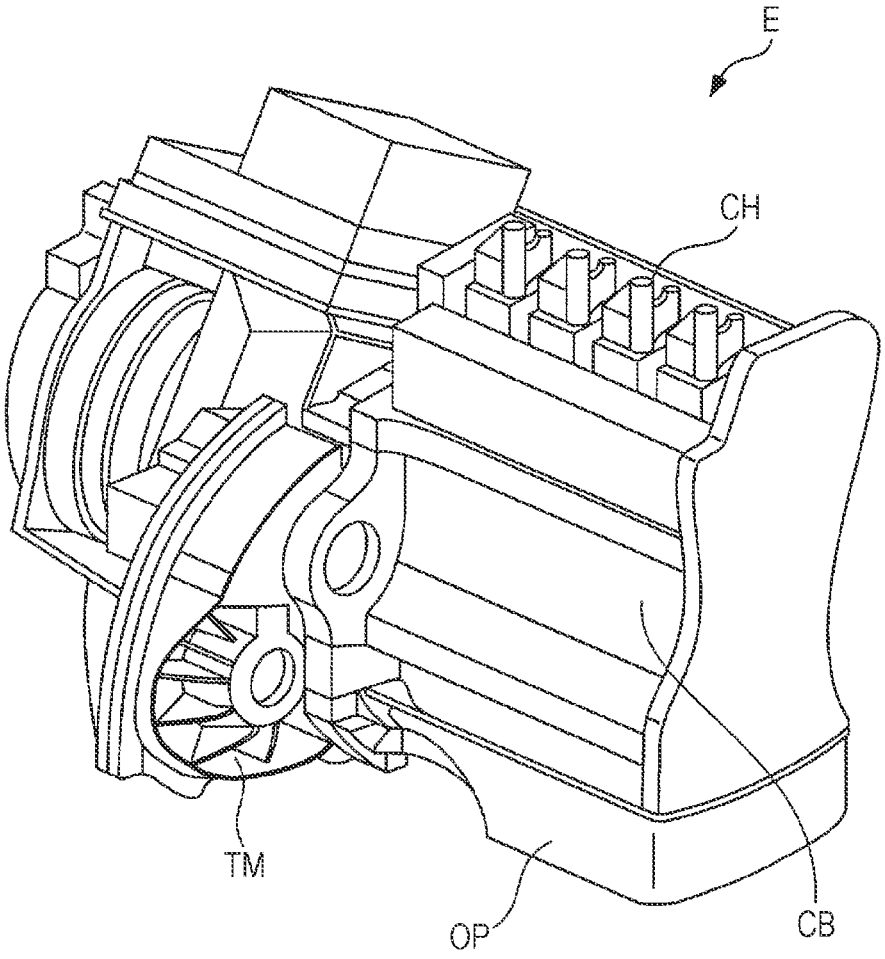
FIG. 1 illustrates a schematic configuration of an internal combustion engine to which an oil pan according to the embodiment of the present disclosure is applied.

FIG. 1 illustrates a schematic configuration of an internal combustion engine to which an oil pan OP according to the present disclosure is applied. An internal combustion engine (hereinafter referred to as "engine") E illustrated in FIG. 1 is a gasoline engine for a vehicle (not illustrated), for example. The engine E includes a cylinder head CH and a cylinder block CB, which have a plurality of cylinders, and the oil pan OP, which is disposed below the cylinder block CB. The engine E is disposed adjacent to a transmission TM. Thus, the oil pan OP is disposed below the cylinder block CB and adjacent to the transmission TM.

Figure 2:
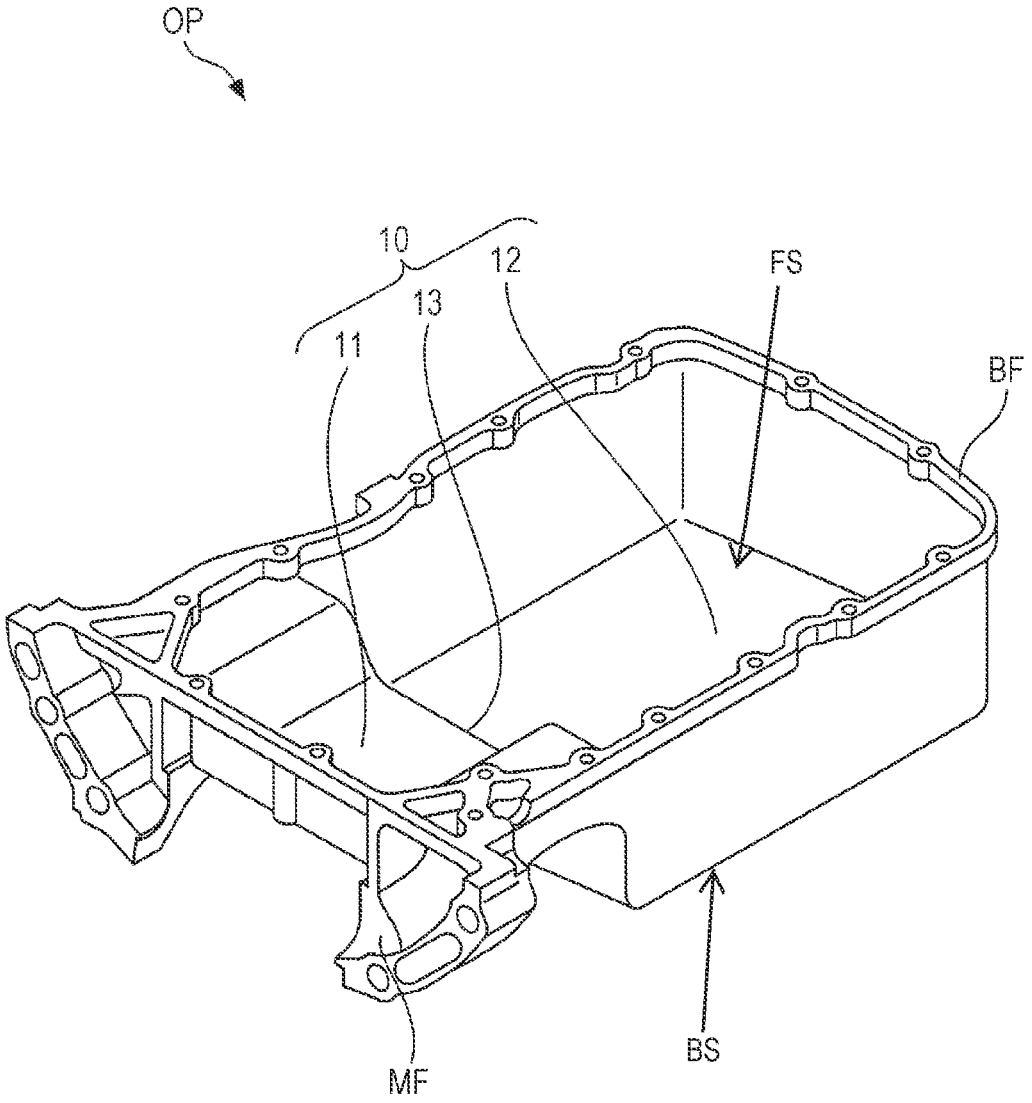
FIG. 2 is a perspective view illustrating the overall structure of the oil pan according to the embodiment.

FIG. 2 is a perspective view illustrating the overall structure of the oil pan OP. FIG. 2 is a diagram in which the oil pan OP is viewed from a position closer to the front surface thereof. In the following descriptions, the "front surface" FS of the oil pan OP is the surface on the side on which oil is stored (upper surface in FIG. 2) of the oil pan OP, and the "back surface" BS of the oil pan OP is the surface opposite to the front surface (lower surface in FIG. 2) of the oil pan OP.

As illustrated in FIG. 2, the oil pan OP includes a storing portion 10, which stores oil to be supplied to the engine E. The storing portion 10 includes the shallow bottom portion 11, the deep bottom portion 12, which is deeper than the shallow bottom portion 11, and a connection surface 13, which connects the shallow bottom portion 11 and the deep bottom portion 12 between the shallow bottom portion 11 and the deep bottom portion 12.

The shallow bottom portion 11 is a portion of the storing portion 10 that is relatively shallow. The deep bottom portion 12 is a portion of the storing portion 10 that is relatively deep and is disposed adjacent to the shallow bottom portion 11 in the longitudinal direction of the oil pan OP. The connection surface 13 connects the shallow bottom portion 11 and the deep bottom portion 12 and is formed so as to extend in a substantially vertical direction between the shallow bottom portion 11 and the deep bottom portion 12. As described above, the storing portion 10 is configured such that the shallow bottom portion 11, the connection surface 13, and the deep bottom portion 12 are connected in this order in the longitudinal direction. The front surface and the back surface of the storing portion 10 are each formed into a step-like shape due to the difference in depth between the shallow bottom portion 11 and the deep bottom portion 12.

A block flange BF, which is configured to be in contact with the cylinder block CB, is formed at an end portion (upper end portion in FIG. 2) of the front surface of the storing portion 10 of the oil pan OP. Thus, the upper surface of the oil pan OP is fixed to the cylinder block CB, which has a high rigidity, via the block flange BF.

A side wall is formed, at a position facing the connection surface 13 with the shallow bottom portion 11 interposed therebetween, at an end portion closer to the transmission TM (left end in FIG. 2) of the oil pan OP in the longitudinal direction. The side wall is a transmission flange MF, which forms a part of the transmission TM disposed adjacent to the oil pan OP. As described above, the end portion closer to the transmission TM of the oil pan OP is the transmission flange MF, which has a high rigidity.

Figure 3:
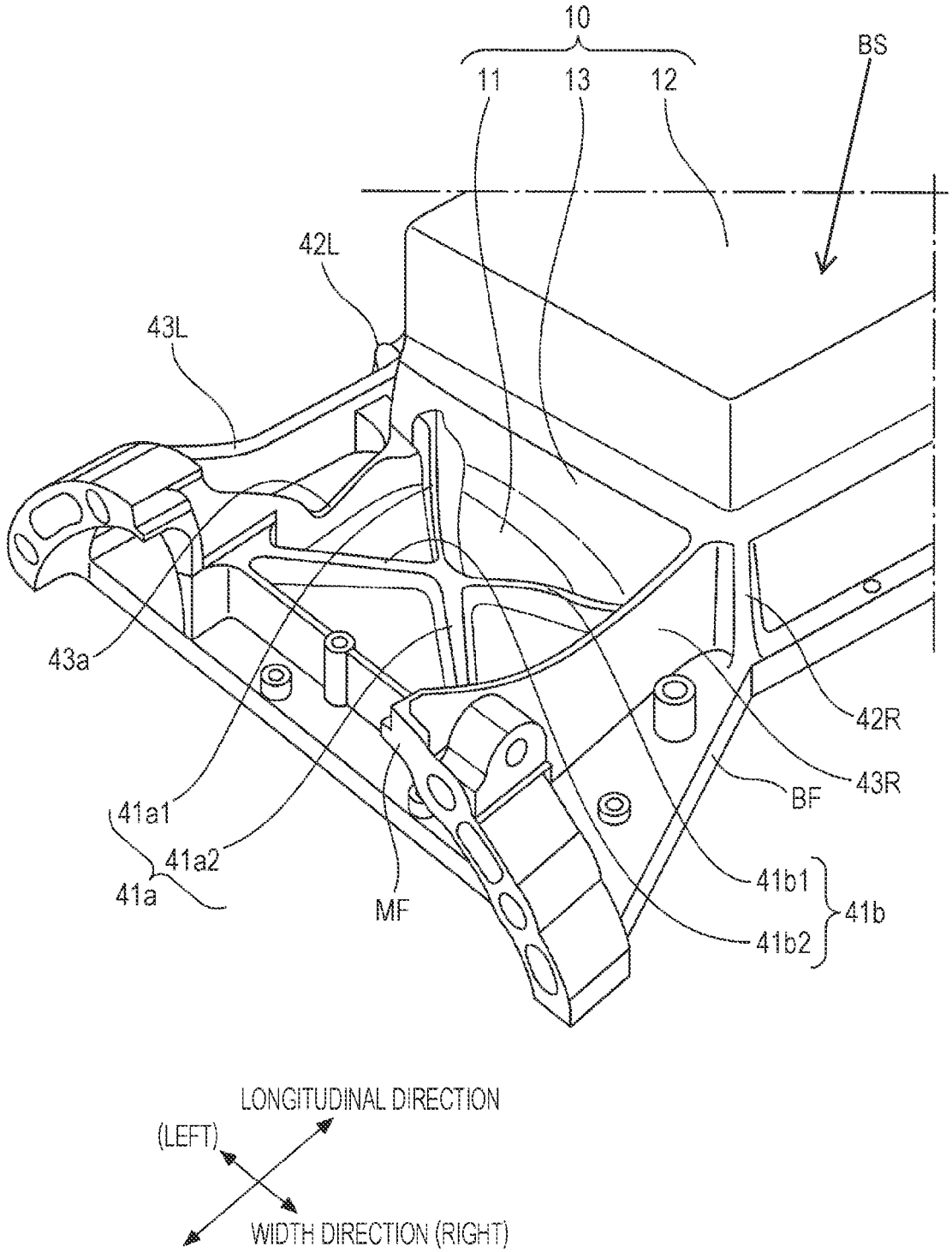
FIG. 3 is a perspective view illustrating a rib structure formed on the back surface of the oil pan according to the embodiment.
Figure 4:
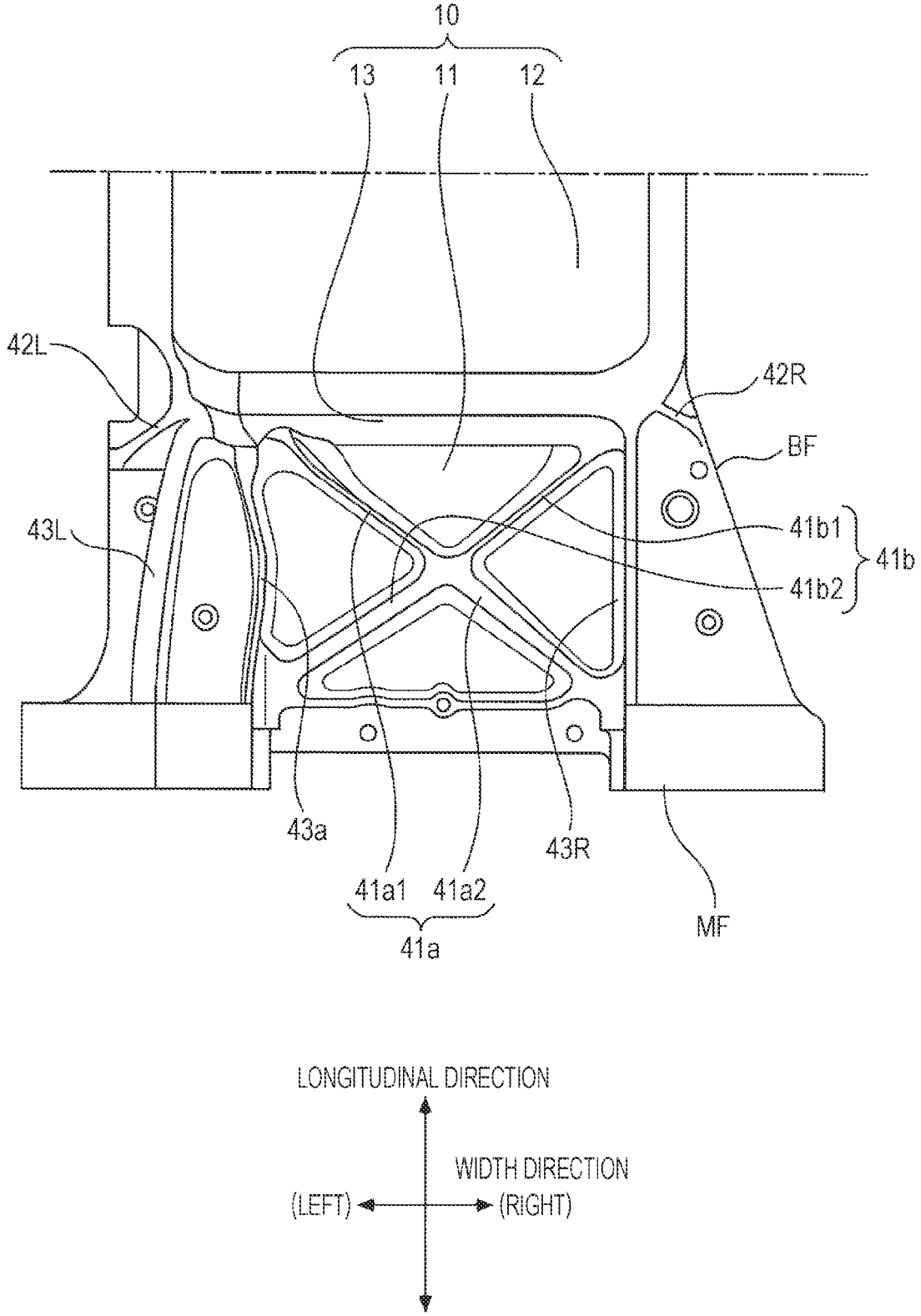
FIG. 4 is a plan view illustrating the rib structure formed on the back surface of the oil pan according to the embodiment.

Next, the rib structure of the oil pan OP will be specifically described with reference to FIGS. 3 and 4. FIG. 3 is a perspective view illustrating the rib structure formed on the back surface BS of the oil pan OP. FIG. 4 is a plan view illustrating the rib structure formed on the back surface of the oil pan OP.

As described above, the transmission flange MF is formed on the surface of the oil pan OP facing the connection surface 13 with the shallow bottom portion 11 interposed therebetween. The rib structure of the embodiment is formed, mainly on the back surface of the shallow bottom portion 11, at positions ranging from the transmission flange MF to the connection surface 13. Specifically, the rib structure includes a first rib 41, which is formed on the back surface of the shallow bottom portion 11, a second rib 42, which is formed on the connection surface 13, and a third rib 43, which is formed at positions outside the first rib 41 in the width direction. This will be specifically described below. In the following descriptions, the terms "right" and "left" respectively denote the right and the left in the width direction in FIGS. 3 and 4.

The first rib 41 is an X-shaped rib formed on the back surface of the shallow bottom portion 11 such that two ribs (a rib 41*a* and a rib 41*b*) intersect each other. The rib 41*a* and the rib 41*b* are each formed continuously so as to range from the transmission flange MF to a corresponding end portion of the connection surface 13 and each connect the transmission flange MF and the connection surface 13.

The two ribs 41*a* and 41*b* are each formed on the back surface of the shallow bottom portion 11 so as to extend from one side or the other side of the transmission flange MF in the width direction toward the corresponding end portion of the connection surface 13 on the opposite side in the width direction. Specifically, the rib 41*a* is formed so as to extend from the right side of the transmission flange MF in the width direction toward an left end portion of the connection surface 13 in the width direction. The rib 41*b* is formed so as to extend from the left side of the transmission flange MF in the width direction toward a right end portion of the connection surface 13 in the width direction. As described above, the rib 41*a* and the rib 41*b* are each formed on the back surface of the shallow bottom portion 11 having a rectangular shape so as to be along a corresponding diagonal line of the rectangular shape.

The thickness of each of the rib 41*a* and the rib 41*b* of the embodiment at a corresponding position closer to the connection surface 13 in the longitudinal direction is smaller than that at the position where the rib 41*a* and the rib 41*b* intersect each other. Specifically, the rib 41*a* is formed such that a portion 41*a*1, which is closer to the connection surface 13, is smaller in thickness than a portion 41*a*2, which is farther from the connection surface 13. The rib 41*b* is formed such that a portion 41*b*1, which is closer to the connection surface 13, is smaller in thickness than a portion 41*b*2, which is farther from the connection surface 13. The thickness described herein includes the thickness of the oil pan OP in the height direction in addition to the thickness in the width direction.

The second rib 42 is a rib formed at both end portions of the back surface of the connection surface 13 in the width direction. The second rib 42 includes a rib 42R, which is formed along a right end portion of the connection surface 13 in the width direction, and a rib 42L, which is formed along a left end portion of the connection surface 13 in the width direction. The rib 42R and the rib 42L are each formed so as to reach the back surface of the block flange BF.

The third rib 43 is a rib extending from the transmission flange MF to the connection surface 13 in the longitudinal direction. The third rib 43 includes a rib 43R, which is formed on the right side with respect to the first rib 41 in the width direction of the back surface of the oil pan OP, and a rib 43L, which is formed on the left side with respect to the first rib 41 in the width direction of the back surface of the oil pan OP, and a fourth rib 43*a* is formed between the first rib 41 and the rib 43L. The rib 43*a* is formed so as to be smaller in thickness than the rib 43L, in particular, such that a portion closer to the connection surface 13 of the rib 43*a* is smaller in thickness than a portion farther from the connection surface 13 of the rib 43*a*.

As described above, according to the embodiment, the first rib 41 (41*a*, 41*b*) is formed on the back surface of the shallow bottom portion 11 so as to extend from one side or the other side of the transmission flange MF in the width direction toward an end portion of the connection surface 13 on the opposite side in the width direction. Thus, the back surface of the shallow bottom portion 11 is reinforced in the diagonal directions. As a result, the rigidity of the oil pan OP can be efficiently increased by ribs whose number is less than, for example, that of ribs formed into a grid-like pattern in the width direction and the longitudinal direction of an oil pan or that of ribs formed in a direction orthogonal to the width direction of a shallow bottom portion. Accordingly, it is possible to increase the rigidity of the connection surface 13 between the shallow bottom portion 11 and the deep bottom portion 12 with the oil pan OP reduced in weight.

In addition, the second rib 42 (42R, 42L) is formed so as to be along the end portions of the back surface of the connection surface 13 and to reach the back surface of the block flange BF. Thus, the second rib 42 increases the rigidity of the end portions of the connection surface 13 and is connected to the block flange BF, which has a high rigidity. Accordingly, this configuration can increase the rigidity of the connection surface 13 more than the case in which only the first rib 41 is formed.

In addition, the second rib 42 disposed at the end portions of the connection surface 13 in the width direction enables the connection surface 13 to have high rigidity. In this case, the oil pan OP can be reduced in weight by forming the first rib 41 such that the portions thereof closer to the connection surface 13 are smaller in thickness than the portions thereof farther from the connection surface 13.

In addition, the first rib 41 is configured such that the two ribs 41*a* and 41*b* formed in the corresponding diagonal directions intersect each other. This configuration reinforces the whole back surface of the shallow bottom portion 11 and thus enables the rigidity of the oil pan OP to be effectively increased.

In addition, the first rib 41 is formed so as to range from the transmission flange MF to the end portions of the connection surface 13. This configuration enables the end portions having relatively high rigidity of the connection surface 13 and the transmission flange MF having a high rigidity to be connected and the rigidity of the oil pan OP to thus be effectively increased.

In addition, the side wall formed on the back surface of the oil pan OP at a position facing the connection surface 13 with the shallow bottom portion 11 interposed therebetween is the transmission flange MF, which forms a part of the transmission TM. As described above, the configuration in which the side wall is the transmission flange MF having a high rigidity and the first rib 41 is formed so as to be connected to the transmission flange MF enables the rigidity of the oil pan OP to be effectively increased.

In addition, the third rib 43 (43R, 43L, 43*a*) is formed on the shallow bottom portion 11 at positions outside the first rib 41 in the width direction. This configuration further increases the rigidity of the oil pan OP. In addition, the configuration in which the third rib 43 is formed so as to range from the transmission flange MF to the connection surface 13 enables the rigidity of the oil pan OP to be increased.

The present disclosure is not limited to the embodiment described above and can be implemented with various modes. For example, the number of ribs included in each of the first rib 41, the second rib 42, and the third rib 43 is not limited to the number in the embodiment. Specifically, the number of ribs included in the first rib 41 may be three or more. The number of ribs included in the second rib 42 may be one or three or more. The number of ribs included in the third rib 43 does not have to be three.

In addition, in the embodiment described above, the oil pan OP is disposed adjacent to the transmission TM, and the side wall of the oil pan OP is the transmission flange MF, which forms a part of the transmission TM, but the configuration of the oil pan OP is not limited thereto. For example, the oil pan OP may be disposed adjacent to a drive mechanism, and the side wall of the oil pan OP may be a flange that forms a part of the drive mechanism. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

What is claimed is:

1. An oil pan structure for an internal combustion engine, the oil pan structure comprising a storing portion that stores oil for an internal combustion engine, wherein the storing portion includes a shallow bottom portion, a deep bottom portion having a larger depth than a depth of the shallow bottom portion, and a connection surface that connects the shallow bottom portion and the deep bottom portion between the shallow bottom portion and the deep bottom portion, wherein the shallow bottom portion and the deep bottom portion are arranged adjacent to each other along a longitudinal direction of the oil pan structure, wherein the oil pan structure comprises a side wall disposed at an opposite side of the shallow bottom portion from the connection surface, a first rib is disposed on a back surface of the shallow bottom portion so as to extend from one side of the side wall in a width direction of the shallow bottom portion toward an end portion of the connection surface on an opposite side in the width direction which is opposite to the one side, wherein the width direction of the shallow bottom portion is perpendicular to the longitudinal direction of the oil pan structure wherein the first rib extends diagonally with respect to longitudinal direction of the oil pan structure, and wherein the first rib connects a portion of the side wall located on the one side of the side wall in the width direction and the end portion of the connection surface located on the opposite side of the connection surface in the width direction.

2. The oil pan structure according to claim 1, wherein the internal combustion engine includes a cylinder block, a block flange configured to be in contact with the cylinder block is disposed on a front surface of the storing portion, and a second rib is disposed so as to extend along the end portion of the connection surface to reach a back surface of the block flange.

3. The oil pan structure according to claim 2, wherein the first rib is configured such that a portion of the first rib positioned closer to the connection surface is smaller in thickness than a portion of the first rib positioned farther from the connection surface.

4. The oil pan structure according to claim 1, wherein the first rib includes at least two ribs, and the at least two ribs are disposed so as to intersect with each other.

5. The oil pan structure according to claim 1, wherein the first rib is disposed so as to range from the side wall to the end portion of the connection surface.

6. The oil pan structure according to claim 1, wherein the internal combustion engine is disposed adjacent to a transmission or a drive mechanism, and the side wall is a flange that constitutes a part of the transmission or the drive mechanism.

7. The oil pan structure according to claim 1, wherein a third rib ranging from the side wall to the connection surface is disposed on one side and the opposite side with respect to the first rib in the width direction of the back surface of the shallow bottom portion.

8. The oil pan structure according to claim 7, wherein a fourth rib extending from the side wall to the connection surface is disposed on the back surface of the shallow bottom portion between the third rib and the first rib in the width direction of the shallow bottom portion.

9. The oil pan structure according to claim 1, wherein the shallow bottom portion, the deep bottom portion and the connection surface are connected to constitute a step shape and the connection surface is a rise surface of the step shape.

10. The oil pan structure according to claim 1, wherein the side wall has a flange structure.

* * * * *